US010649380B2

(12) United States Patent
Shoshani et al.

(10) Patent No.: US 10,649,380 B2
(45) Date of Patent: May 12, 2020

(54) INK DEVELOPMENT

(71) Applicant: HP Indigo B.V., Amstelveen (NL)

(72) Inventors: Asaf Shoshani, Ness Ziona (IL); Lavi Cohen, Ness Ziona (IL); Ido Finkelman, Ness Ziona (IL); Meir Grinstein, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/332,965

(22) PCT Filed: Sep. 30, 2016

(86) PCT No.: PCT/EP2016/073528
§ 371 (c)(1),
(2) Date: Mar. 13, 2019

(87) PCT Pub. No.: WO2018/059721
PCT Pub. Date: Apr. 5, 2018

(65) Prior Publication Data

US 2019/0258198 A1 Aug. 22, 2019

(51) Int. Cl.
*G03G 15/08* (2006.01)
*G03G 15/00* (2006.01)
*G03G 15/10* (2006.01)

(52) U.S. Cl.
CPC ..... *G03G 15/50* (2013.01); *G03G 15/104* (2013.01); *G03G 15/6594* (2013.01); *G03G 15/10* (2013.01); *G03G 15/80* (2013.01)

(58) Field of Classification Search
CPC ..... G03G 15/065; G03G 15/5058; G03G 15/0806; G03G 15/5008; G03G 15/556
USPC ..... 399/53
See application file for complete search history.

(56) References Cited

U.S. PATENT DOCUMENTS

| | | | | |
|---|---|---|---|---|
| 6,122,460 | A | 9/2000 | Meece et al. | |
| 2004/0105702 | A1 | 6/2004 | Kurotori et al. | |
| 2009/0097883 | A1* | 4/2009 | Guzman | G03G 15/104 399/249 |
| 2010/0150583 | A1* | 6/2010 | Hitaka | G03G 15/553 399/28 |
| 2010/0245447 | A1 | 9/2010 | Kohne et al. | |
| 2012/0003015 | A1 | 1/2012 | Brown | |
| 2012/0057195 | A1 | 3/2012 | Shiraishi | |
| 2015/0343762 | A1* | 12/2015 | Shaul | B41J 2/0057 347/103 |
| 2016/0124356 | A1 | 5/2016 | Tamada et al. | |
| 2016/0216631 | A1 | 7/2016 | Gila et al. | |

FOREIGN PATENT DOCUMENTS

| | | | |
|---|---|---|---|
| JP | S6048358 | A | 3/1985 |
| WO | WO-2016015777 | A1 | 2/2016 |

OTHER PUBLICATIONS

Ricoh Aficio SP 5200DN/SP 5210DN, <https://ricoh-usa.com/-/media/Ricoh/Common/PDFs/Brochures/aficiosp5200dn.pdf>.

* cited by examiner

*Primary Examiner* — Walter L Lindsay, Jr.
(74) *Attorney, Agent, or Firm* — Middleton Reutlinger

(57) ABSTRACT

In one example, a development cycle of a binary ink developer, BID, is timed. Timing may be based on the length of a substrate in which the image is to be printed or the size of the image or the area to be printed with the ink associated to the BID.

12 Claims, 10 Drawing Sheets

INK DEVELOPMENT

BACKGROUND

In order to print, digital offset presses may rely on ink development for transferring ink to an intermediate unit, such as a photoreceptor. An ink developer may comprise a developer roller which may transfer ink by contacting the intermediate unit.

DETAILED DESCRIPTION

Hereinafter, examples are mainly directed to printing systems and methods, e.g., using electrophotographic printers or digital presses.

Figure 1:
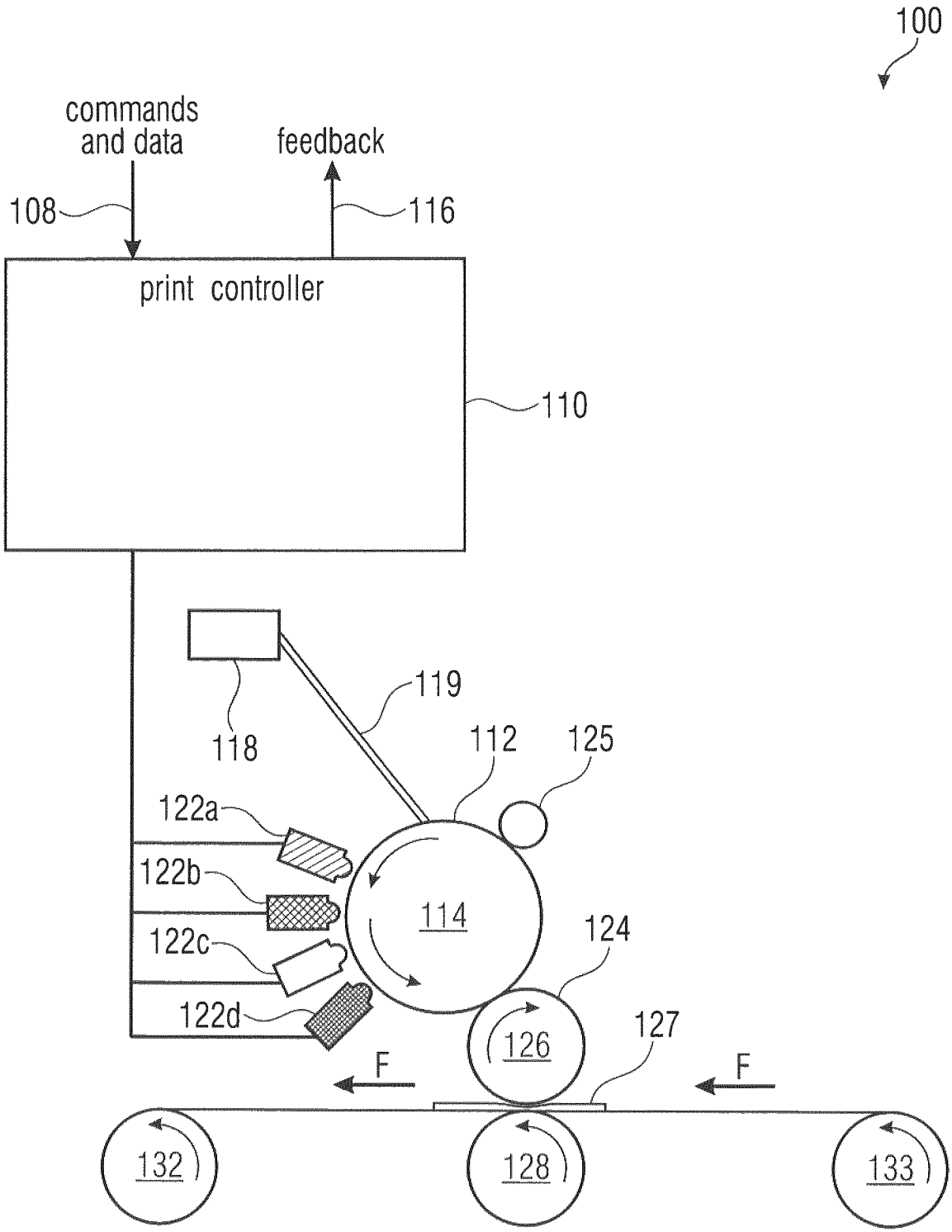
FIG. 1 shows a print system according to an example.

FIG. 1 shows an example of print system 100, which may be a digital offset press, e.g., a liquid toner electrophotographic printer (LEP). The print system 100 may comprise a print controller 110. The print controller 110 may manage the print of images. The print controller 110 may receive commands and data 108 from a user, e.g., through a typographical application. The user may also be remote, e.g., connected thorough a geographical network. The print controller 110 may also provide feedback (e.g., notifications or alarms) 116, e.g., to the user.

The print system 100 may include a photo imaging component, such as a photoreceptor (image plate) 112, which may be mounted on a photoreceptor/imaging drum/cylinder 114. The photoreceptor 112 may define an outer surface of the imaging drum 114 on which images are formed. A charging component such as charge roller 125 connected to electrical power units (not shown) may generate electrical charge that flows toward the photoreceptor surface and cover it with a uniform electrostatic charge. A laser imaging unit (writing head) 118 may selectively expose the photoreceptor 112 with a laser beam 119, in particular exposing image areas on the photoreceptor 112 and dissipating (neutralizing) the charge in some areas. Exposure of the photoreceptor 112 in this manner creates a "latent image" in the form of an invisible electrostatic charge pattern that replicates the image to be printed.

After the latent electrostatic image is formed on the photoreceptor 112, the image may be developed by binary ink developers (BIDs) 122*a*, 122*b*, 122*c*, and 122*d*, to form an ink image on the outer surface of the photoreceptor 112. Each BID may develop one ink color of the image, and each developed color may correspond with one image impression or color separation. While four BIDs are shown, indicating a four color process (i.e., a CMYK process based on Cyan, Magenta, Yellow, and Black colors), other implementations may include different BIDs corresponding to additional colors.

According to an example, in a first image transfer, a single color separation impression of the ink image developed on the photoreceptor 112 may be transferred from the photoreceptor 112 to an image transfer blanket 124. The image transfer blanket 124 may be wrapped around and securely fastened to the outer surface of an intermediate transfer member (ITM) drum 126. The first image transfer that transfers ink from the photoreceptor 112 to the print blanket 124 is driven by an applied mechanical pressure between the imaging drum 114 and the ITM drum 126, and electrophoresis of the electrically charged ink particles. The electric field that drives the ink transfer may be created by a bias voltage applied to the print blanket 124.

The print blanket 124 may be heated by both internal and external heating sources such as infrared heating lamps (not shown), e.g., under the control of the print controller 110. The heated print blanket 124 may cause most of the carrier liquid and solvents in the transferred ink image to evaporate. The heated blanket 124 may also cause particles in the ink to partially melt and blend together. This results in a finished ink image on the blanket 124 in the form of a hot, nearly dry, tacky plastic ink film.

In a second image transfer, the hot ink film image impression may be transferred from the blanket 124 to a substrate 127 such as a sheet of print media (e.g., paper). The substrate 127 may be held or supported by an impression (IMP) drum/cylinder 128. Contact pressure between the ITM drum 126 and IMP drum 128 may compress the blanket 124 against the substrate 127 to facilitate the transfer of the hot ink film image. The temperature of the substrate 127 is below the melting temperature of the ink particles, and as the ITM drum 126 and IMP drum 128 rotate against one another under pressure, the hot ink film comes into contact with the cooler substrate 127 and causes the ink film to solidify and peel off from the blanket 124 onto the substrate 127.

The substrate 127 may be fed in the direction of the length of the substrate 127, which may be along a feeding direction (print direction) F. Rollers 132 and 133 and/or the IMP drum 128 may be used for feeding. Motor units, which may be controlled by the print controller 110, may be used to drive the movements.

In some implementations, an intermediate transfer member may be avoided, and ink is directly transferred from the photoreceptor 112 to the substrate.

The process may be repeated for each color separation in the image. E.g., in a 4-shot printing process the colors accumulate in successive revolutions on the substrate 127 wrapped on the IMP drum 128 until all the color separation impressions (e.g., C, M, Y, and K) in the image are transferred to the substrate 127.

Elements such as the laser imaging unit 118, the BIDs, and the electric devices which control the printing voltages applied to the BIDs may be controlled by the print controller 110. Also motor units which drive the rotation of at least some of the imaging drum 114, the ITM drum 126, and IMP drum 128 may be controlled by the print controller 110.

The print controller 110 may perform a timing of a development cycle of a binary ink developer, BID, on the basis of the length of the substrate 127 or the size of the image or the area to be printed with the ink associated to the BID.

Figure 2:
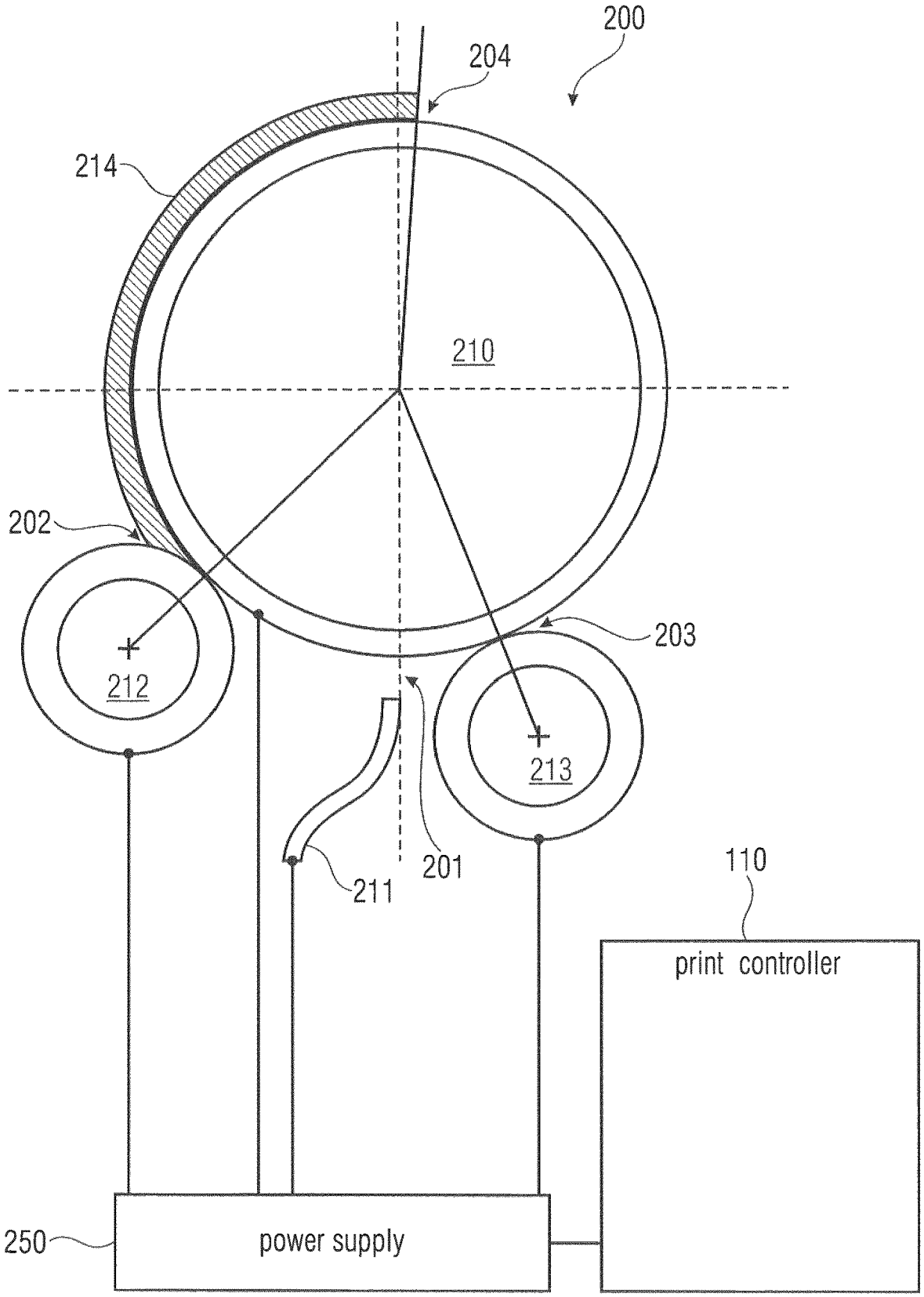
FIG. 2 shows a developer unit according to an example.

FIG. 2 is a schematic view illustrating a BID assembly 200, which may constitute one of BIDs 122*a*-122*d*.

The BID assembly 200 may include a developer roller 210. The developer roller 210 may be in contact with the photoreceptor 112 (e.g., at location 204) for transferring ink to the photoreceptor 112. It is possible to selectively engage/disengage the developer roller 210 with/from the photoreceptor 112. For example, when a particular colorant is to be applied to a substrate, a BID associated to the particular colorant is engaged to the photoreceptor, while the other BIDs are disengaged from the photoreceptor. The developer roller 210 may be a rotatable float element which rotates by virtue of the rotation of the imaging drum 114, when the BID assembly 200 and the imaging drum 114 are connected to each other. In FIG. 2, the developer roller 210 rotates in clockwise direction.

The BID assembly 200 may include at least one electrode, e.g., the electrode 211, which may create potential bias, to transfer ink particles to the developer roller 210. Ink may be liquid ink, for example, or solid ink, or a mixture of liquid and solid ink particles. As a consequence of the electrical potential of the electrode 211, the ink particles may be electrically charged, e.g., negatively charged or positively charged, according to the type of ink and the charge of the electrode 211. The distal end of the electrode 211 may protrude towards the developer roller 210 in correspondence with location 201 in FIG. 2.

The BID assembly 200 may include a squeegee roller 212. The squeegee roller 212 may regulate the film thickness of the ink on the developer roller 210. Numeral 202 indicates the contact region between the squeegee roller 212 and the developer roller 210. The squeegee roller 212 may be a rotatable float element whose rotation is driven by the rotation of the developer roller 210. The squeegee roller 212 may have a diameter which is less than a half of that of the developer roller 210.

The BID assembly 200 may include a cleaner roller 213. The cleaner roller 213 may be in contact with the developer roller 210 and a wiper (not shown). The cleaner roller 213 may rotate to clean the developer roller 210. Accordingly, unused ink (i.e., ink which has not been transferred to the photoreceptor 112) may be removed from the developer roller 210. Numeral 203 indicates the contact region between the cleaner roller 213 and the developer roller 210. The cleaner roller 213 may be a rotatable float element which is rotated by virtue of the rotation of the developer roller 210.

In FIG. 2, numeral 214 refers to a layer of ink which has been placed on the surface of the developer roller 210 and which is transferred to the photoreceptor 112 at location 204.

In general, ink is transferred to the lateral surface of the developer roller 210 between locations 201 and 202. In some examples, the majority of ink arrives from the position 201 corresponding to the electrode 211, while the minority of ink arrives from the position 202 corresponding to the squeegee 212. Ink is subsequently moved to the photoreceptor 112 in correspondence with location 204.

At least some of these elements may be electrically charged so as to perform an electrostatic transfer of ink. The differences of potential between different elements may determine movements of charged ink particles. For example, the difference of potential between the developer roller 210 and the photoreceptor 112 may cause selective transfer of the layer of toner particles to the photoreceptor 112.

FIG. 2 also shows electrical connections between elements of the BID and a power supply (PS) 250. The PS 250 may be controlled by the print controller 110. The PS 250 may control at least one of the developer roller 210, the electrode 211, the squeegee roller 212, and the cleaning roller 213. The control may be such that an electrical value associated to at least one element of the BID assembly 200 is imposed to an element 210, 211, 212, or 213. The control may be such that a voltage of at least one element of the BID assembly 200 may be controlled, at least during some time slots. The control may be such that a voltage of at least one element of the BID assembly 200 may be floating, for example during some time slots which are not the time slots in which the voltage is imposed. The PS 250 may control the timing of the elements and the electric variables of at least some of the elements of the BID.

The power supply 250 may contain at least one rectifier (e.g., one for each of the controlled elements). The power supply 250 may contain at least one inverter, a chopper, a buck-boost converter, or similar. The inverter and/or the rectifiers may comprise a combination of silicon-based power switches. The inverter and/or the rectifiers may comprise a combination of diodes, bipolar junction transistors (BJTs), metal-oxide-semiconductor field-effect transistors (MOSFETs), thyristors, and in particular gate turn-off thyristors (GTOs). The power supply 250 may also comprise or be connected to a filter and/or linear element, such as a capacitor or an inductor. The power supply 250 may also be supplied by a mains, e.g. a monophase or threephase mains. The power supply 250 may also comprise or be connected to elements such as a transformer or an auto-transformer, e.g., for modifying the supply voltage. The power supply 250 may be localized in correspondence with the BID assembly 200. The power supply 250 may be remote from of the BID assembly 200. Some elements of the power supply 250 may be spatially distributed. The power supply (or at least a part of it) may be centralized for all the BIDs 122*a*-122*d*. Alternatively, each BID 122*a*-122*d* may have its independent own PS. In this case, a communication network or another king of logical link between the PS and, in case, a control logic may also be provided. The PS may be controlled by the print controller 110 or by a dedicated logic element, such as a processor, controller, digital signal processor (DSP), which in turn may be commanded by the print controller 110. The PS may be synchronized to the motor unit moving the imaging drum 114 so as the mutual rotation of the imaging drum 114 and the developer roller 210 is controlled.

The BID assembly 200 may be either mechanically engaged to the photoreceptor 112 or disengaged from the photoreceptor 112. A mechanical engaging unit (not shown), which may be controlled by the print controller 110, may force the movement of the BID. In an engaged position, the developer roller 210 may be in contact with the photoreceptor 112 so as to permit transfer of ink to the photoreceptor 112.

Figure 3:
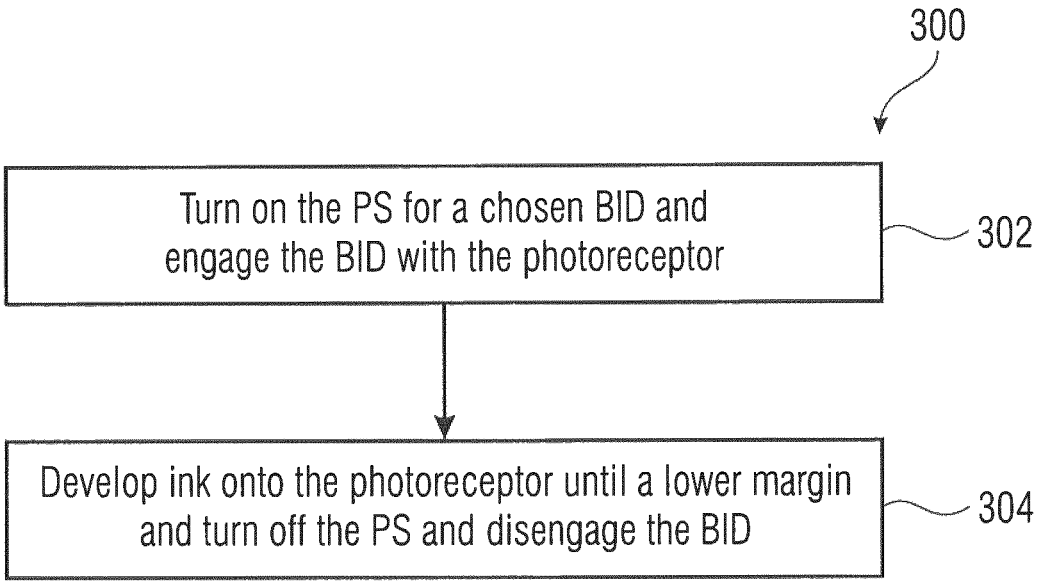
FIG. 3 shows a method according to an example.

FIG. 3 shows a method 300 for performing a BID cycle. At block 302, the PS 250 may be turned on for a chosen BID. For example, voltages may be imposed to at least one of the developer roller 210, the electrode 211, the squeegee roller 212, and the cleaning roller 213. Simultaneously or quasi-simultaneously, the BID may be mechanically engaged to the imaging drum, e.g., by touching the photoreceptor 112.

At block 304, ink may be selectively developed onto the photoreceptor 112, while the imaging drum 114 rotates, so as to impinge the photoreceptor 112 with ink in accordance to the electrostatic charge pattern created by the laser beam 119. When approaching the end of the print, the PS 250 may be shut off and the chosen BID may be disengaged.

Figure 4:
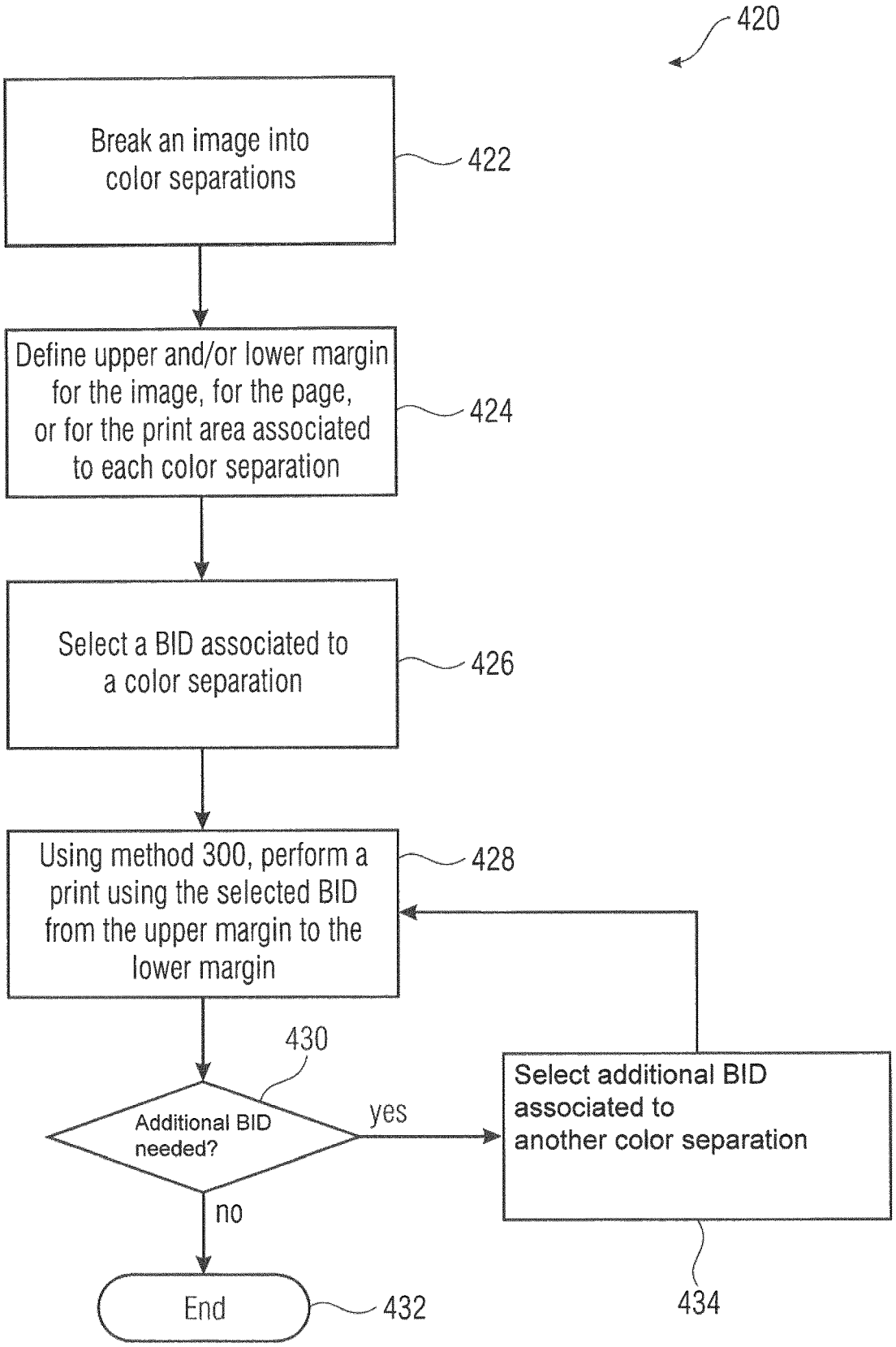
FIG. 4 shows a method according to an example.

FIG. 4 shows a method 420 for performing a print operation. At block 422, an image to be printed may be divided into a plurality of color separations. For example, a color separation could be associated to a colorant, which may be, for example, Cyan, Magenta, Yellow, and Black. For each color separation, an associated print area may be calculated. The print area may comprise the dots or pixels which are to be represented in the printed image by transferring a particular ink in the positions associated to the pixels. A pixel may be represented by superposing a plurality of different colorants in the same position. Block 422 may be implemented, for example, by performing a control by a routine in the print controller 110.

At block 424, an upper margin may be defined for performing the print. For example, an upper margin of the page (or the print frame that has to be printed) may be defined. Alternatively, an upper margin of the image may be defined. The upper margin of the image could be the first line that is to be printed within the page (or frame). An upper margin of the print area of the color separation may be defined. If, for example, a colorant is to be placed in the last lines of the page, the upper margin for that colorant may be one of the last lines of the page.

Additionally or alternatively, at block 424, a lower margin may be defined. For example, a lower margin of the page (or print frame) may be defined. Alternatively, a lower margin of the image to be printed may be defined. A lower margin of the print area of the color separation may be defined. If, for example, a colorant is to be placed in the first lines of the page to be printed, the upper margin for that colorant may be one of the first lines of the page.

With reference to FIG. 1, when looking the substrate 127 as printed in the print direction F, the upper margin is before the lower margin. In FIG. 1, an upper margin is at the left of a respective lower margin.

Notably, the upper/lower margins are defined in the page or in the print frame of the substrate 127. However, corresponding upper/lower margins are also defined in the latent image on the photoreceptor 112:

Block 424 may be executed by the print controller 110. In case the definition of the upper and/or lower margins is not based on the particular color separation, block 424 may also precede block 422 or may be executed in parallel to block 422, in some examples.

At block 426, a first BID may be selected. The BID may be associated to one of the color separations. For example, when Black is to be printed, the BID containing Black colorant is chosen.

At block 428, the method 300 may be performed. The print may be performed starting from the upper margin defined in block 424. With reference to FIG. 1, the substrate 127 may be, for example, transported towards the upper margin. The BID cycle defined by method 300 may be synchronized to the upper margin: the PS 250 may be turned on for preparing the start of ink transfer in correspondence with the upper margin. Additionally or alternatively, the developer roller 210 may be engaged to the photoreceptor 112 so as to start impinging ink onto the photoreceptor 112 (and subsequently onto the substrate 127) from the upper margin.

Accordingly, the mechanical engagement between the developer roller 210 and the photoreceptor 112 is performed to prepare the deposition of ink starting from the upper margin. No physical contact between the developer roller 210 and the photoreceptor 112 may be provided in correspondence with portions of the photoreceptor associated to regions which, in the substrate 127, are before the upper margin.

For the selected BID, the print may end at the lower margin defined in block 424. The BID cycle may therefore be synchronized to arrive at the lower margin: the PS 250 may be shut off in correspondence with the lower margin. With reference to FIG. 2, the last ink particles of the ink layer 214 may arrive at position 204 exactly when the lower margin of the printed image is formed in the photoreceptor 112. After the lower margin has been formed, the developer roller 210 may carry no ink layer. The developer roller 210 may be disengaged from the photoreceptor 112 so as to avoid contact between the developer roller 210 and the photoreceptor 112.

Accordingly, an ink layer (e.g., ink layer 214 in FIG. 2) is present on the surface of the developer roller 210 until the lower limit is reached.

At block 430, it is determined if an additional BID is needed, e.g., to apply a colorant which has not been transferred to the substrate 127. If the print job is completed, the method ends at block 432. A new print job may be prepared, whose print may follow the same or a similar procedure. Block 430 may be avoided in some cases, e.g., when performing a monochromatic print using only one single ink developer.

If the print operation is not ended and an additional BID is to be used for the same print job, the additional BID is selected at block 434, e.g., in association to another color separation defined at block 422. In some examples, the upper and/or the lower margin for the additional BID are the same of the upper and/or the lower margin for the preceding BID.

In other examples, the upper margin or the lower margin for the additional BID may be in general different from the upper margin or the lower margin for the first BID, as a consequence of the different disposition of the colors in the image. Accordingly, the method 420 may be performed for the time in which a particular area is printed and, therefore, the BID is used when appropriate.

Iterations between blocks 428, 430, and 434 may therefore be defined. The iterations may end when all the inks have been applied to the substrate 127 and the print job is completed.

In order to arrive at the upper margin for a new iteration, it may be possible to rewind the substrate 127, for example in a direction antiparallel to the print direction F shown in FIG. 1.

Figure 5A:
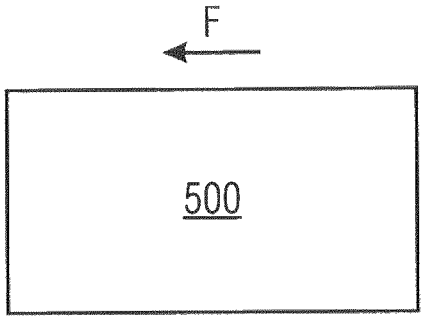
FIGS. 5*a*-5*c* show sequences of a method according to an example.
Figure 5B:
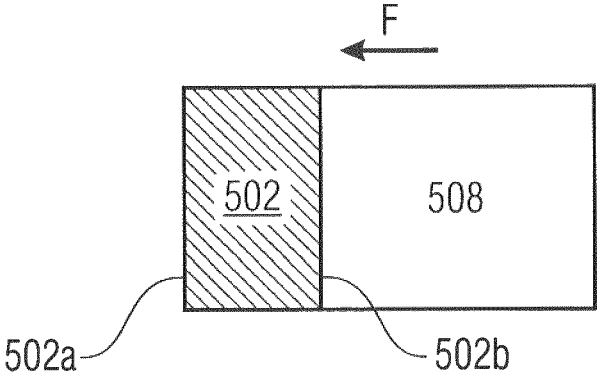
Figure 5C:
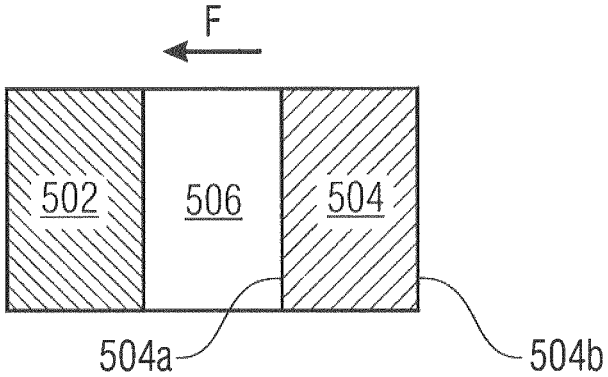

A conceptual example may be derived by FIGS. 5*a*-5*c*, in which an Italian flag (which has three adjacent bands respectively Green, White, and Red and is represented in FIG. 5*c*) is to be printed in the print direction F (e.g., from left to right in FIGS. 5*a*-5*c*), by a printer having at least Red and Green BIDS, on an originally white substrate 500. Accordingly, at block 422 the image is broken into a Green color separation and a Red color separation. The margins defined at block 424 are to correspond to the margins of the flag's bands 502, 504, and 506. During a first iteration of method 420, at block 428 the Green band 502 is printed along the direction F between upper margin 502*a* and lower margin 502*b*. A Green BID is engaged to the photoreceptor for transferring Green colorant to the substrate 500 in correspondence with the band 502 to be printed. In correspondence with the lower margin 502*b* of the flag band 502 (e.g., in correspondence with transferring to the developer roller 210 the ink that is to form the lower margin 502*b*), the PS for the Green BID may be shut off. Accordingly, the BID cycle is approximately 33.33% with respect to the length of the substrate 500. For the second iteration, the Red BID is selected at block 434. The BID cycle is defined at block 428 between upper and lower margins 504*a* and 504*b*. Even in this case, the BID cycle for the Red ink is approximately the 33.33% with respect to the length of the substrate 500. Mechanical engagement of the BID with the photoreceptor is not carried out and the PS is off when the margin 504*a* is not reached.

Figure 6:
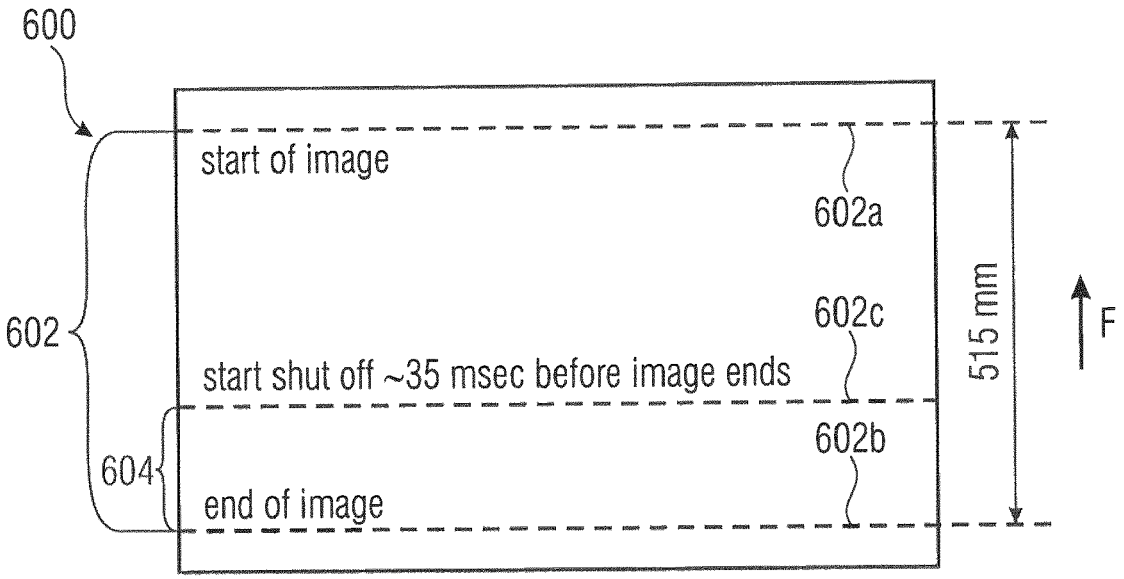
FIG. 6 shows a print according to an example.

FIG. 6 shows parts of an image 602 printed on a substrate 600. The image may be printed in the print direction F between an upper margin 602*a* and a lower margin 602*b*. The BID assembly 200 may be used. FIG. 6 also shows a line 602*c* intermediate to the margins 602*a* and 602*b*. The line 602*c* and the lower margin 602*b* define a final portion 604 of the image 602.

Some numerical examples are here provided. Different values may be obtained as consequences of choosing different drum diameters, different substrates, etc.

The image length may be 515 mm, for example. With the angular values shown in the following Table 1 and an angular velocity of 3.6°/ms for the developer roller 210, the following values may be obtained:

TABLE 1

| Points (x->y) (as shown in FIG. 2) | Angles (in °) | Time from x to y (100% velocity) (in ms) | Time from x to y (101% velocity) (in ms) |
|---|---|---|---|
| 201->202 | 46.4° | 12.88 | 12.76 |
| 201->203 | 338° | 93.06 | 93.06 |
| 201->204 | 184° | 50.06 | 50.6 |
| 202->203 | 292° | 80.3 | 80.3 |
| 202->204 | 137.6° | 37.84 | 37.84 |
| 203->201 | 21.6° | 5.94 | 5.94 |
| 204->203 | 154° | 42.3 | 42.3 |

The 100% angular velocity may be obtained by the formula:

$$\text{velocity} = \frac{\text{angle}(x \text{ -> } y)}{360 \cdot t(x \text{ -> } y)}$$

From Table 1 it is possible to derive that the angle between locations 202 and 204 (which in the present numerical example is 137.6°) may be rotated in 37.84 ms, which may approximate 35 ms. This angle corresponds to the maximum value of the arc of the developer roller 210 on which ink layer 214 is deposited (FIG. 2) from the squeegee roller 212 to the contact point 204 of the developer roller 210 with the photoreceptor. That ink is used to print the final portion 604 of image 602 (between the intermediate line 602*c* and the lower margin 602*b*). Basically, it is possible, in some examples, to perform a timing of the BID assembly 200 so that the last portion 604 of the image 602 is formed in the photoreceptor 112 while the shut-off operation is started.

Figure 7:
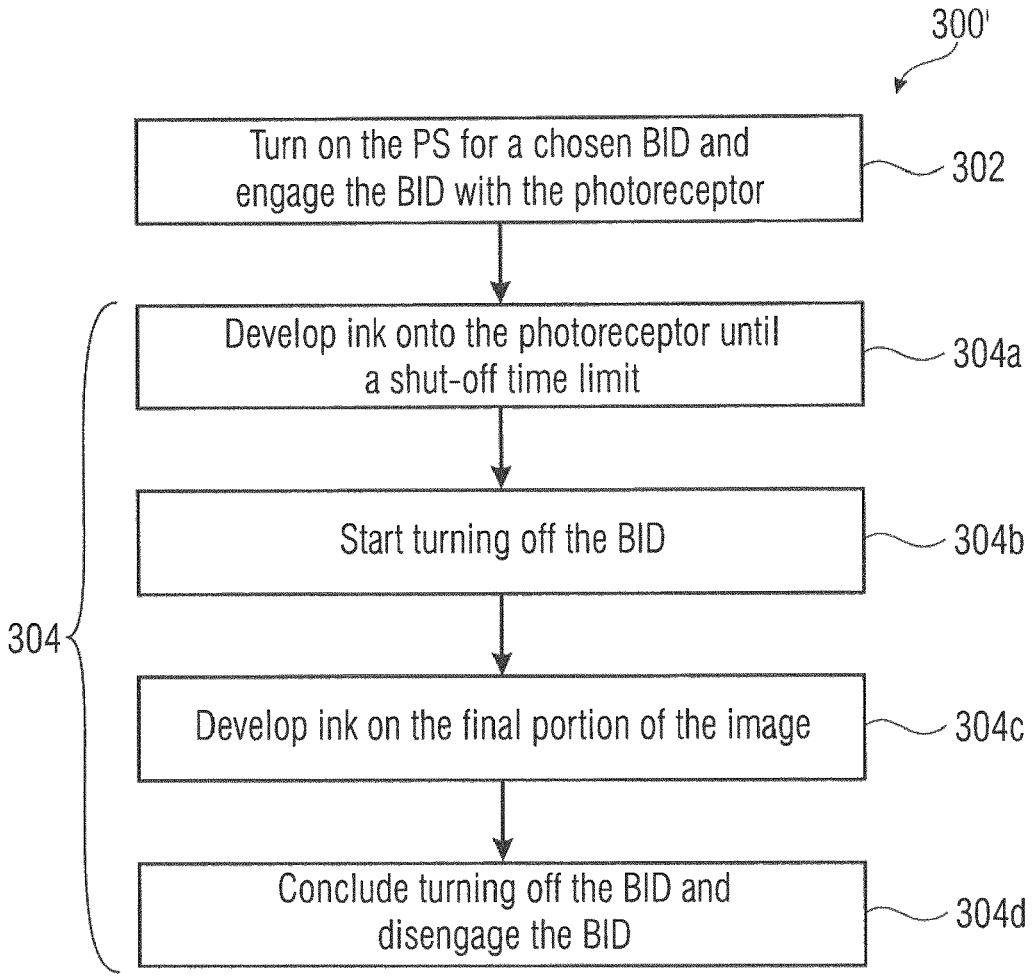
FIG. 7 shows a method according to an example.

Therefore, it is possible to define a BID cycle, e.g., defined by a method 300' shown in FIG. 7, which may comprise a block 302 analogous to the block 302 of method 300 of FIG. 3.

Method 300' may also comprise a sequence of blocks which may correspond to block 304 of method 300. In particular, at block 304*a*, ink may be developed onto the photoreceptor 112 until a shut-off time limit. The shut-off time limit may correspond, for example, to the instant during which the intermediate line 602*c* is formed in the photoreceptor 112.

At block 304*b*, which occurs when the shut-off time limit is reached, the PS 250 starts being shut off.

At block 304*c*, the remaining ink 214 (visible in FIG. 2) is transferred to the photoreceptor 112 while the developer roller 210 describes an angle between locations 202 and 204 (which in case of Table 1 is 137.6°) and the PS is shutting off.

At block 304*d*, which may occur when the last particles of ink 214 are transferred to the photoreceptor 112, the turn off may be completed and the BID may be disengaged from the photoreceptor.

The shut-off time limit is such that ink 214, remaining in the developer roller 210, may still be applied to the photoreceptor 112 while the PS is turning off. Therefore, when the lower margin of a print area is calculated, it is also possible to calculate the shut-off time limit by taking into account the position of the lower margin, structural parameters, and velocity values of the developer roller. In particular, by shutting off the electrode 211 while the final portion 604 of the image 602 is still being formed in the photoreceptor 112 without shutting off the developer roller 210, the transfer of the last particles of ink to the photoreceptor 112 may still continue until the lower margin 602*b*.

Figure 8:
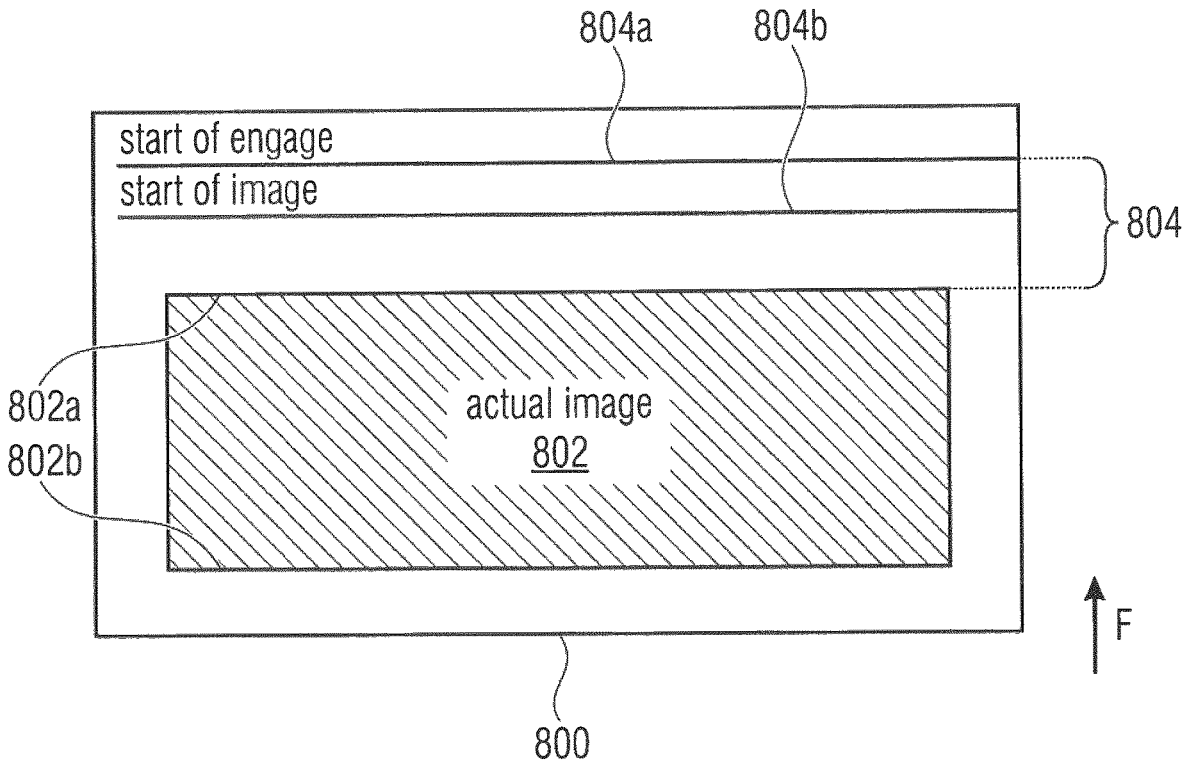
FIG. 8 shows a print according to an example.

FIG. 8 shows an image 802 which is printed on substrate 800 in print direction F. The image 802 has an upper margin 802*a* and a lower margin 802*b*. In some examples, the image 802 may also be a print area of a particular color separation, e.g., as defined in block 422.

A turn-on phase (80 ms~180 ms, for example) may be used to turn on the elements of the BID assembly 200. Before engagement, a time slot of about 70 ms may be waited. Approximately 50 ms may be waited for ink to arrive at the line "start of the image" 804*b*. 20 ms may be waited for stabilizing the voltages on the elements of the BID.

The developer roller 210 may be engaged to the photoreceptor 112 at location 204, but ink is not applied to the developer roller 210. At engagement, the latent image of the photoreceptor 112 which is in contact with location 204 corresponds to line "start engage" 804*a*. Driven by the rotation of the imaging drum 114, the developer roller 210 may start rotating. The first portion of ink arrives at the photoreceptor 112 in correspondence with (or just before) the upper margin 802*a*. Using the numerical values of Table 1, the angle between the locations 201 and 204 may be 184° and the time implied for this rotation may be 50.06 ms. The length 804 in FIG. 8 may correspond (or be calculated on the basis of) to the arc (e.g., 184° in Table 1) between the locations 201 and 204.

Hence, it is possible to retard the engagement between the developer roller 210 and the photoreceptor 112, e.g., until the last possible instant. Accordingly, the BID may be synchronized with the upper margin of the actual image to be printed.

Figure 9:
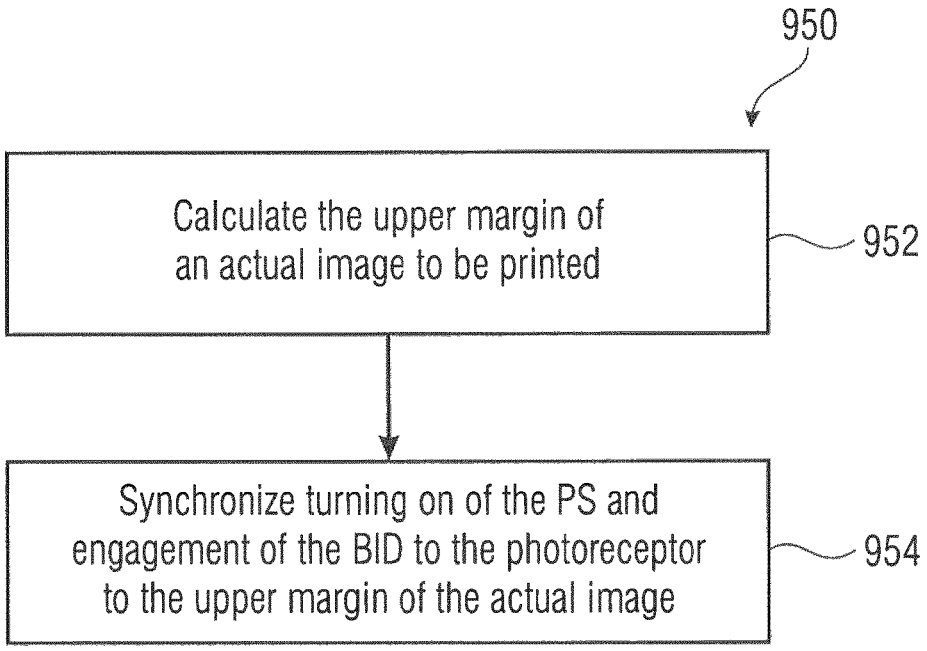
FIG. 9 shows a method according to an example.

FIG. 9 shows a method 950 for performing the BID cycle above. Accordingly, the upper margin of an actual image to be printed is calculated at step 952. At step 954, the operations of turning on and engaging the photoreceptor are performed so that ink development starts in correspondence to the upper margin 802*a* of the actual image 802 and not before.

Figure 10:
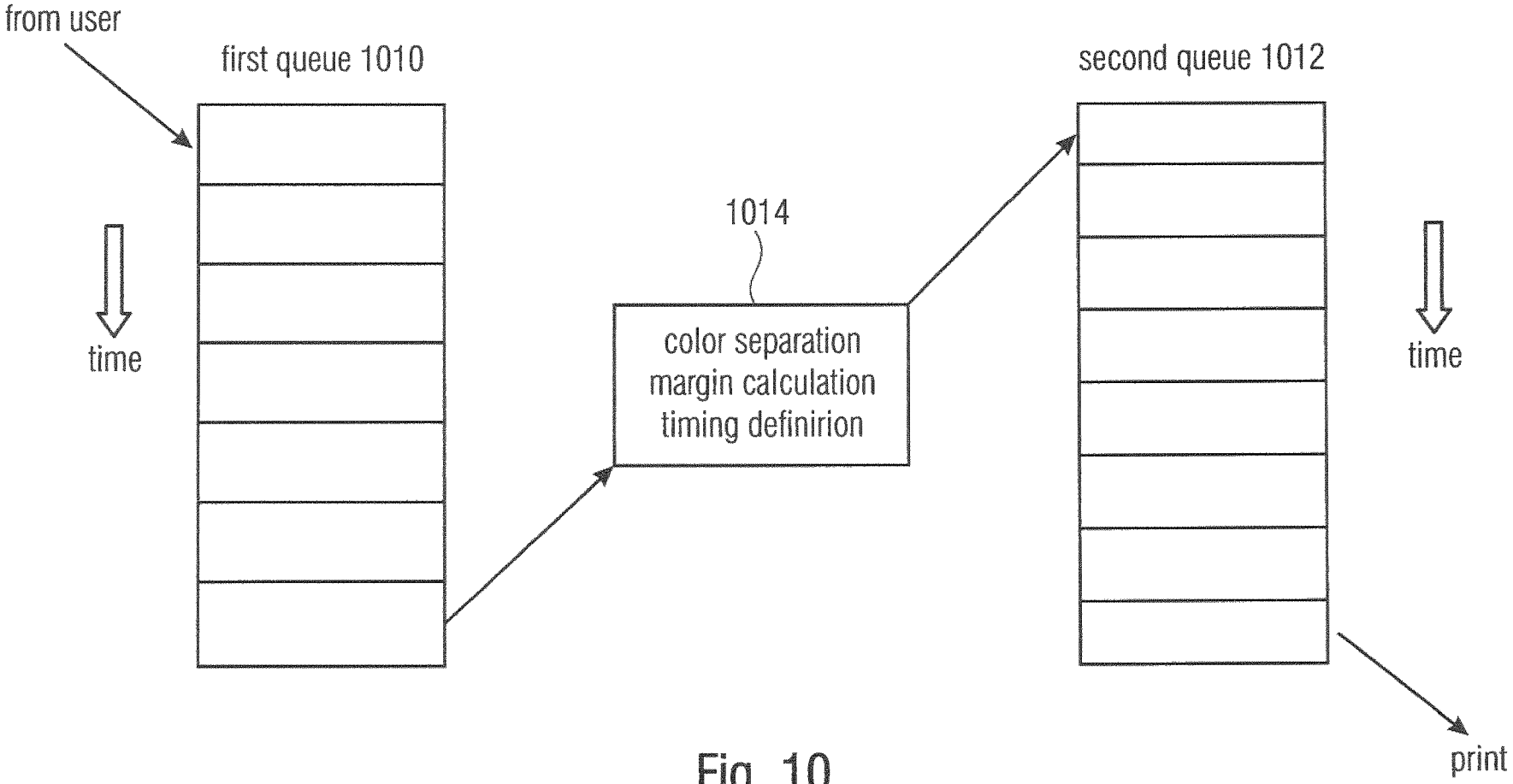
FIG. 10 shows a method according to an example.

The methods described above may operate in real time. An example is shown in FIG. 10. A first queue 1010 may be defined. The first queue 1010 may receive print job requests, e.g., by a user, which may use a geographical network (e.g., internet), a typographical application, and so on. The print jobs in the first queue 1010 (which may be a first-in-first-out, FIFO, queue) may be transmitted to a second queue 1012. The second queue 1012 may be internal to a memory device which is associated or part to the print controller 110, for example. The print jobs in the second queue are processed to be printed, e.g., sequentially, if queue 1012 is a FIFO queue. Between the first and the second queues, each print job may be processed at block 1014 (which may be implemented, for example, by the print controller 110). For example, at block 1014 a print job may be divided between color separations as in block 422 of FIG. 4. Additionally or alternatively, at block 1014 margin calculations of a page of the print job, of an image of the print job, or of a print area for each color separation may be performed. Additionally or alternatively, at block 1014 timing of the engagement and timing of the electric values to be imposed to the elements of the BID is defined. For example, the BID cycle is calculated. For example, the shut-off time limit may also be calculated.

The results of the processes performed at block 1014 may be saved together with the other entries of the second queue 1012 and used for printing and developing ink. In some examples, the second queue 1012 may be avoided and the block 1014 may be directly transmitted to the print.

Figure 11:
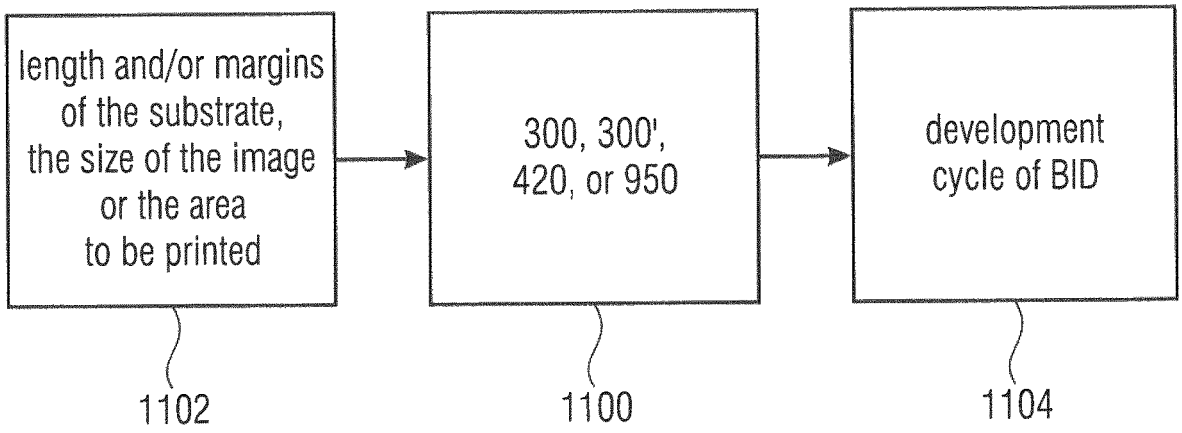
FIG. 11 shows a method according to an example.

FIG. 11 shows a block scheme 1100 in which a development cycle 1104 of BID is determined on the basis of an input 1102 which may comprise the length and/or of the margins of a substrate in which the image is to be printed or the size of the image or the area to be printed with the ink associated to the BID. The block scheme 1100 may be performed, for example, by implementing one of the methods 300, 300', 420, or 950, and may be obtained using at least one of the devices shown in FIG. 1 or 2.

The development cycle may therefore be reduced: a developer roller may be engaged to the photoreceptor for a limited time.

In general, a photoreceptor may present a seam on its surface. The presence of the seam may reduce the print quality. It is possible to avoid a seam with an engaging/disengaging movement of the developer roller. The probability of encountering seams is, notwithstanding, reduced. Therefore, less engaging/disengaging movements are implied.

By reducing the number of the engaging/disengaging movements, reliability is increased, e.g., for the BID and the photoreceptor.

It is possible to reduce the ink that is provided to the developer roller. In fact, the BID is not always engaged to the photoreceptor. Hence, ink consumption is reduced.

A reduction of the background phenomenon has been observed. The background phenomenon is due to the deposition of ink where it is not supposed to be. As the BID specifically operates where ink is to be applied, the occurrence of the background phenomenon is less probable. An accumulation of dry ink layer is also reduced. This accumulation tends, with time, to cause scratches in the photoreceptor. These scratches tend prevent ink from being placed in the intended position. However, in view of the reduction of the development cycle, this phenomenon is also reduced.

In experiments, it has been noted that, in fact, the quality of the printed product has been increased.

Figure 12:
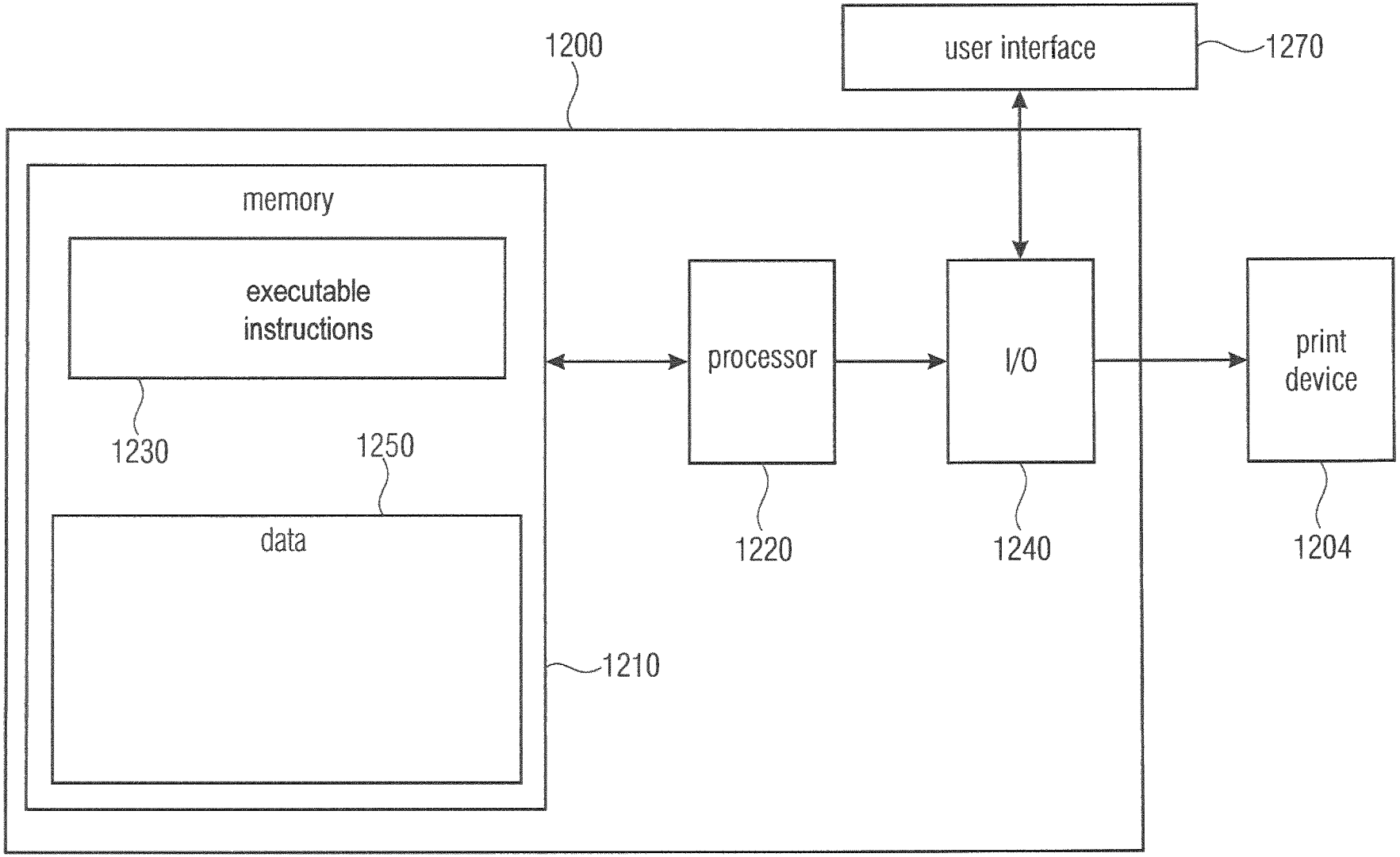
FIG. 12 shows a computer system according to an example.

FIG. 12 shows a system 1200 which may be an example of the system controller 102. The system 1200 may comprise a processor 1220 and a memory 1210 which contains executable instructions 1230 which, when executed by the processor 1220, causes the processor to perform at least one of the operations described above. For instance, instructions 1230 may cause a timing of a development cycle of a binary ink developer, BID, on the basis of the length of a substrate or the size of an image or an area to be printed with the ink associated to the BID. The processor 1220 may be connected, e.g., through an I/O device 1240, to a user interface 1270 and/or to a printer 1204.

The memory 1210 may contain a data space 1250 with data for the processor 1220. The data space 1250 may contain information on timing a development cycle of a binary ink developer, BID, on the basis of the length of a substrate in which the image is to be printed or the size of the image or the area to be printed with the ink associated to the BID. Margin calculations and timing information may be stored in the memory 1210.

Depending on certain implementation requirements, examples may be implemented in hardware. The implementation may be performed using a digital storage medium, for example a floppy disk, a Digital Versatile Disc (DVD), a Blu-Ray Disc, a Compact Disc (CD), a Read-only Memory (ROM), a Programmable Read-only Memory (PROM), an Erasable and Programmable Read-only Memory (EPROM), an Electrically Erasable Programmable Read-Only Memory (EEPROM) or a FLASH memory, having electronically readable control signals stored thereon, which cooperate (or are capable of cooperating) with a programmable computer system such that the respective method is performed. Therefore, the digital storage medium may be computer readable.

Some examples comprise a data carrier having electronically readable control signals, which are capable of cooperating with a programmable computer system, such that one of the methods described herein is performed.

Generally, examples may be implemented as a computer program product with program instructions, the program instructions being operative for performing one of the methods when the computer program product runs on a computer. The program instructions may for example be stored on a machine readable carrier.

Other examples comprise the computer program for performing one of the methods described herein, stored on a machine readable carrier.

In other words, an example of method is, therefore, a computer program having a program instructions for performing one of the methods described herein, when the computer program runs on a computer.

A further example of the methods is, therefore, a data carrier (or a digital storage medium, or a computer-readable medium) comprising, recorded thereon, the computer program for performing one of the methods described herein. The data carrier, the digital storage medium or the recorded medium are tangible and/or non-transitionary, rather than signals which are intangible and transitory.

A further example of the method is, therefore, a data stream or a sequence of signals representing the computer program for performing one of the methods described herein. The data stream or the sequence of signals may for example be transferred via a data communication connection, for example via the Internet.

A further example comprises a processing means, for example a computer, or a programmable logic device performing one of the methods described herein.

A further example comprises a computer having installed thereon the computer program for performing one of the methods described herein.

A further example comprises an apparatus or a system transferring (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some examples, a programmable logic device (for example a field programmable gate array) may be used to perform some or all of the functionalities of the methods described herein. In some examples, a field programmable gate array may cooperate with a microprocessor in order to perform one of the methods described herein. Generally, the methods are preferably performed by any hardware apparatus.

The apparatus described herein may be implemented using a computer.

The apparatus described herein, or any components of the apparatus described herein, may be implemented at least partially in hardware.

The methods described herein may be performed using a hardware apparatus, or using a computer, or using a combination of a hardware apparatus and a computer.

The methods described herein, or any components of the apparatus described herein, may be performed at least partially by hardware.

The above described examples are merely illustrative for the principles discussed above. It is understood that modifications and variations of the arrangements and the details described herein will be apparent. It is the intent, therefore, to be limited by the scope of the impending patent claims and not by the specific details presented by way of description and explanation of the examples herein.

The invention claimed is:

1. A method comprising:

timing a development cycle of a binary ink developer, BID, on the basis of the length of a substrate in which the image is to be printed or the size of the image or the area to be printed with the ink associated to the BID;

wherein the timing is repeated for different inks, and the method comprises determining different upper or lower margins for different inks.

2. A system to control ink development from at least one developer roller to a photoreceptor, the system being to perform at least one of:

starting the development of ink in correspondence with an upper margin of a page, image or print area; and concluding the development of ink in correspondence with a lower margin of a page, image or print area, wherein the at least one developer roller comprises at least a developer roller to be engaged to the photoreceptor and an electrode to develop ink.

3. A non-transitory memory device comprising executable instructions which, when executed by a processor, causes the processor to:

control a first developer roller to start or conclude ink development operations for a first ink based on dimensional parameters of an image or print area to be printed with the first ink; and control a second developer roller to start or conclude ink development operations for a second ink based on based on dimensional parameters of an image or print area to be printed with the second ink.

4. The method of claim 1, wherein timing comprises synchronizing the development cycle to an upper or lower margin of the page, image or print area to be printed.

5. The method of claim 1, wherein timing is performed so that the start of a turn-off procedure of the BID occurs before the conclusion of the development of ink to be used for a print operation.

6. The method of claim 1, wherein timing comprises calculating an amount of ink to be transferred to a developer roller to correspond to a last portion of page, image or print area to be printed.

7. The method of claim 1, further comprising mechanically engaging a developer roller to the photoreceptor to describe a rotation for an angle that causes ink transfer to the photoreceptor in correspondence with the upper margin of the page, image or print are to be printed.

8. The system of claim 2, wherein the system is to develop ink by energizing at least one of the developer roller and the electrode, so that the electrode starts being shut off before the developer roller starts being shut off, so that the developer roller continues developing ink up to reach the lower margin of the page, image or print area.

9. The system of claim 8, wherein the system is to start shutting off the electrode so that a last portion of page, image or print area to be printed corresponds to a rotation angle of the developer roller between the contact point of the developer roller with a squeegee roller and the contact point of the developer roller with the photoreceptor after starting the shut off of the electrode.

10. The system of claim 2, wherein the ink developer is controlled to engage to the photoreceptor in correspondence with a particular position in the substrate so that the distance of the particular position from the upper margin in the substrate corresponds to a rotation angle of the developer roller between the electrode and the contact point of the developer roller with the photoreceptor.

11. The system of claim 2, wherein the at least one developer roller comprises a plurality of ink developers, each ink developer being associated to an ink print area, the system being to define different upper margins and/or lower margins for at least two ink print areas.

12. The memory device of claim 3, wherein the instructions are to cause the processor to control a positional relationship between the ink deposited on each of the first and second developer rollers and a line of substrate to be printed.

* * * * *